US006123581A

United States Patent [19]

Stabile et al.

[11] Patent Number: 6,123,581

[45] **Date of Patent: *Sep. 26, 2000**

[54] POWER BYPASS CONNECTOR

[75] Inventors: David J. Stabile, Horseheads, N.Y.; Scott R. Hopper, Kent, Wash.

[73] Assignee: Thomas & Betts International, Inc., Sparks, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/969,228

[22] Filed: Nov. 13, 1997

Related U.S. Application Data

[60] Provisional application No. 60/030,808, Nov. 14, 1996.

[51] Int. Cl.[7] ..... H01R 9/05

[52] U.S. Cl. ..... 439/578

[58] Field of Search ..... 439/188, 575, 439/675, 944

[56] References Cited

U.S. PATENT DOCUMENTS

| | | | |
|---|---|---|---|
| 3,275,970 | 9/1966 | Johanson et al. | 339/143 |
| 3,953,098 | 4/1976 | Avery, Jr. et al. | 339/45 R |
| 4,697,859 | 10/1987 | Fisher, Jr. | 439/246 |
| 4,815,986 | 3/1989 | Dholoo | 439/248 |
| 4,897,045 | 1/1990 | Dyck | 439/578 |
| 5,329,262 | 7/1994 | Fisher, Jr. | 333/33 |
| 5,439,386 | 8/1995 | Ellis et al. | 439/322 |
| 5,598,132 | 1/1997 | Stabile | 333/22 R |

*Primary Examiner*—Michael L. Gellner
*Assistant Examiner*—Briggitte R. Hammond
*Attorney, Agent, or Firm*—Weingarten, Schurgin, Gagnebin & Hayes LLP

[57] ABSTRACT

A power bypass connector comprises an entry body having a first end configured to mate with an amplifier. The connector also includes a female body having a first end configured to mate with a coaxial cable having a cooperating male connector. The second end of the female body is configured to mate with the second end of the entry body. A terminal is disposed within the female body and extends beyond the end of the male body. An insulator is disposed within the entry body to mechanically and electrically insulate the terminal from the entry body. A support is disposed within the connector, partially within the entry body and partially within the female body and includes a spring which biases the support and the terminal within the connector. The power bypass connector provides power and RF signal around a CATV amplifier to a cable, can conduct up to approximately 15 amperes, provides 75 ohms impedance, and provides RF performance up to approximately 860 MHz.

13 Claims, 2 Drawing Sheets

POWER BYPASS CONNECTOR

CROSS REFERENCE TO RELATED APPLICATIONS

This application claims priority under 35 U.S.C. § 119(e) to provisional patent application Ser. No. 60/030,808 filed Nov. 14, 1996; the disclosure of which is incorporated herein by reference.

STATEMENT REGARDING FEDERALLY SPONSORED RESEARCH OR DEVELOPMENT

Not Applicable

BACKGROUND OF THE INVENTION

A power bypass connector bypasses power and RF signals around a CATV (cable television) amplifier to a cooperating cable. Typically, a bypass connector comprises several parts, is costly and fails to provide for impedance matching between the amplifier and the cooperating cable, resulting in degradation of the RF signal or of the power being bypassed. A power bypass connector which has a reduced number of parts, provides seventy five ohms impedance, can carry up to fifteen amperes of current and provides RF performance up to approximately 860 MHz would be desirable.

BRIEF SUMMARY OF THE INVENTION

A power bypass connector is disclosed. The connector comprises an entry body having a first end configured to mate with a cable television amplifier or other amplifier. The connector also includes a female body having a first end configured to mate with a coaxial cable having a cooperating male connector. The second end of the female body is configured to mate with the second end of the entry body. A terminal is disposed within the female body and extends beyond the first end of the male body. An insulator is disposed within the entry body to mechanically and electrically insulate the terminal from the entry body. A support is disposed within the connector, partially within the entry body and partially within the female body and includes a spring which biases the support and the terminal within the connector. The power bypass connector provides power and/or RF signal bypass around an amplifier to a cable, can conduct up to approximately 15 amperes, provides 75 ohms impedance, and provides RF performance up to approximately 860 MHz.

BRIEF DESCRIPTION OF THE SEVERAL VIEWS OF THE DRAWING

The invention will be more fully understood from the following detailed description taken in conjunction with the accompanying drawings in which.

DETAILED DESCRIPTION OF THE INVENTION

Figure 1:
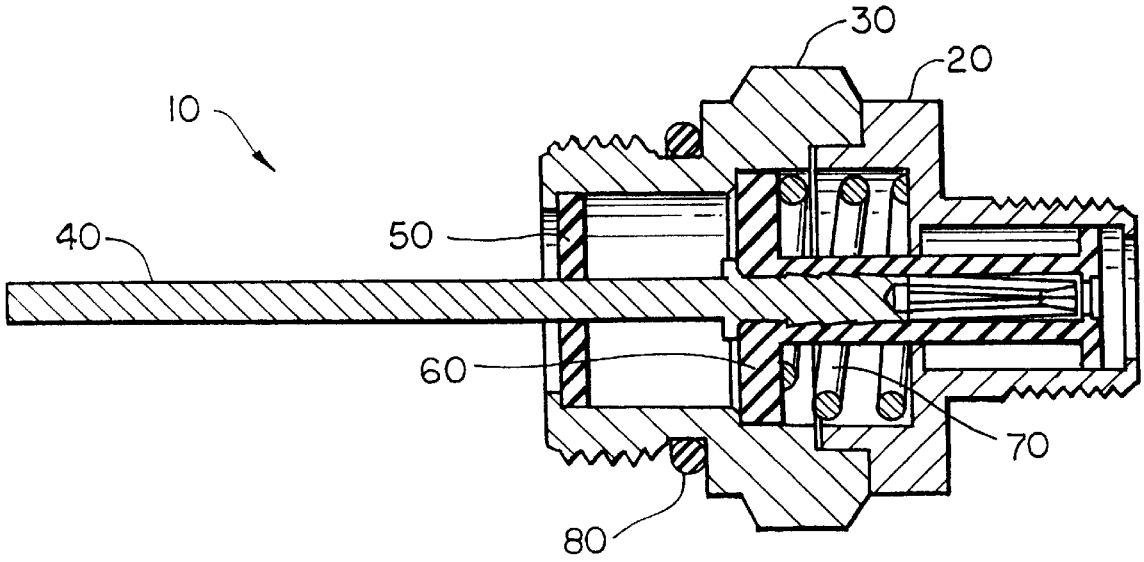
FIG. 1 is a cross-sectional side view of the power bypass connector of the present invention.

Referring to FIG. 1, a power bypass connector 10 according to the present invention is shown. The power bypass connector 10 comprises a female body 20, an entry body 30, a male terminal 40, an insulator 50, a support 60, a spring 70 and an o-ring 80. The power bypass connector is an adapter that bypasses A.C. power and RF signals around the CATV mainstation amplifier for a temporary period, such as during repairs or replacement of the amplifier module.

Figure 2:
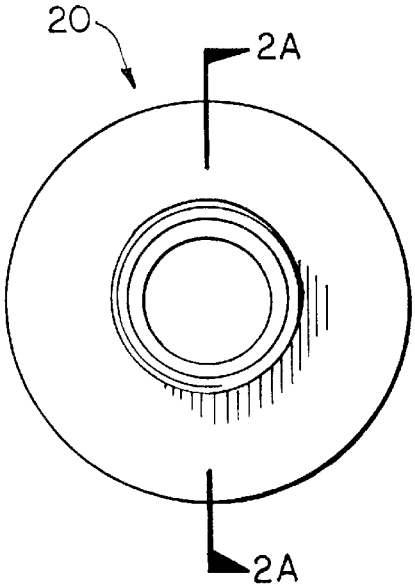
FIG. 2 is an end view of the female body of the power bypass connector of FIG. 1.
Figure 2A:
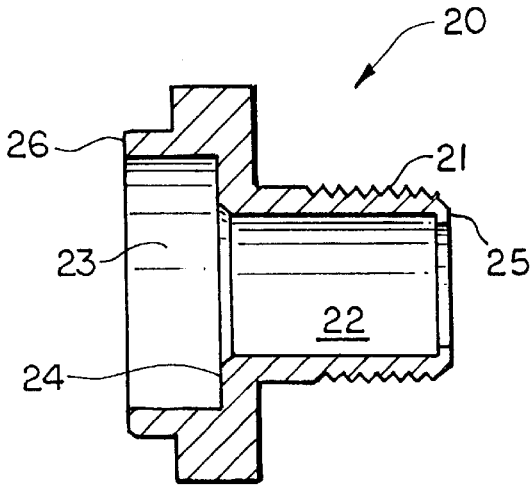
FIG. 2A is a cross-sectional side view of the female body of FIG. 2.

FIGS. 2 and 2A show the female body 20 which is comprised of brass or other conductive material. A first end 25 of the female body 20 includes a first mating area 21, in this embodiment comprising a ⅜"-32 threaded section, which is configured to mate with a cable having a cooperating connector. A first central bore 22 is disposed within, and extends through, female body 20. A second central bore 23 is disposed a predetermined distance within the second end 26 of the female body 20. An inner annular shoulder 24 is provided where first central bore 22 meets second central bore 23.

Figure 3:
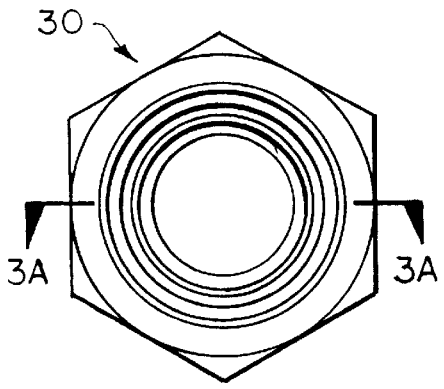
FIG. 3 is an end view of the entry body of the power bypass connector of FIG. 1.
Figure 3B:
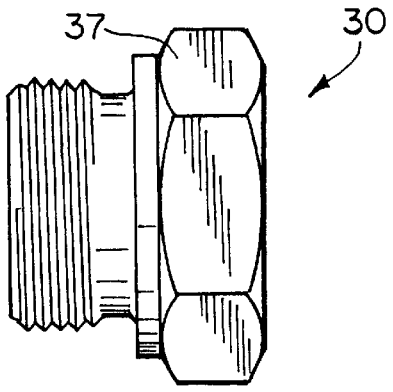
FIG. 3B is a side view of the entry body of FIG. 3.
Figure 3A:
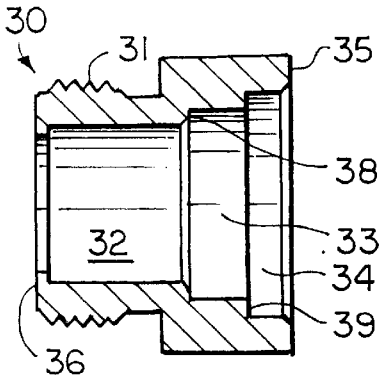
FIG. 3A is a cross-sectional side view of the entry body of FIG. 3.

FIGS. 3–3B show entry body 30. Entry body 30 is comprised of brass or other conductive material. A first end 36 of the entry body 30 includes a first mating area 31, in this embodiment comprising a ⅝"-24 threaded section, for mating with an amplifier. An outer section 37 includes a hexagonal shaped surface in order to provide a surface that allows for sufficient tightening of first end 31 to the amplifier. A first central bore 32 is provided extending through the entry body 30. A second central bore 33 having a larger diameter than the first central bore 32 is provided a predetermined distance within the second end 35 of entry body 30. A first annular shoulder 38 is established where second central bore 33 meets first central bore 32. A third central bore 34 is provided a predetermined distance within the second end 35. Third central bore 34 has a larger diameter than second central bore 33, and thus provides a second annular shoulder 39 where third central bore 34 meets second central bore 33.

Figure 4:
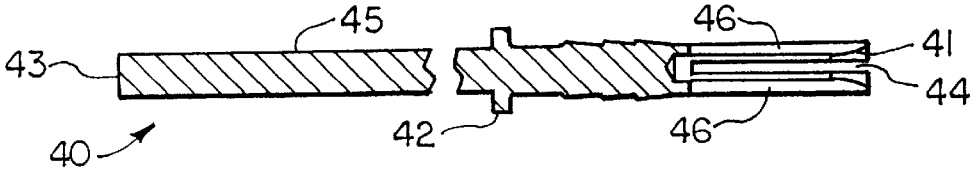
FIG. 4 is a cross-sectional side view of the terminal of the power bypass connector of FIG. 1.

Referring now to FIG. 4, terminal 40 is shown. Terminal 40 is comprised of copper or other conductive material, which may be plated with another conductive material, for example silver. The terminal 40 includes a long cylindrical body 45 having a first end 43 and a second end 41. The first end 43 is shown as a flat tip, however other embodiments could utilize a tip having a different shape such as round, tapered, angled or other. An annular shoulder 42 is provided about an external surface of the body 45. The second end 41 includes a central bore 44 disposed partially therein which is sized to receive a pin terminal of a cooperating male connector. The second end 41 may further include one or more slots forming fingers 46 which aid in the receiving of the pin terminal of the cooperating connector.

Figure 5:
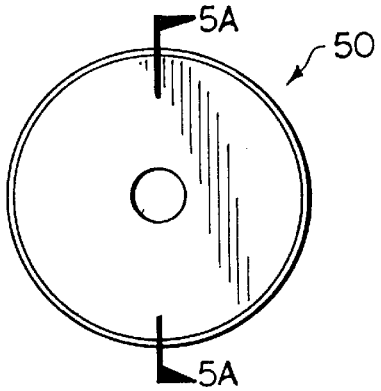
FIG. 5 is an end view of the support of the power bypass connector of FIG. 1.
Figure 5A:
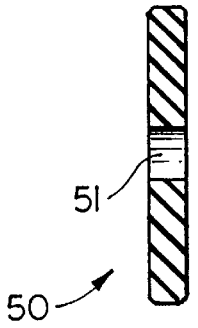
FIG. 5A is a cross-sectional side view of the support of FIG. 5.

FIGS. 5–5A show insulator 50. Insulator 50 is comprised of nylon or other insulative material. A central bore 51 is disposed through insulator 50 and is sized to receive a section of the terminal 40 therethrough. Insulator 50 is sized to fit within the first bore of entry body 30 and mechanically and electrically insulates the terminal from the entry body of the power bypass connector.

Figure 6:
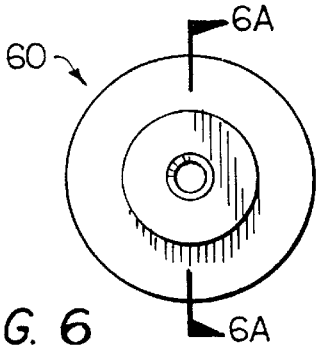
FIG. 6 is an end view of the insulator of the power bypass connector of FIG. 1.
Figure 6A:
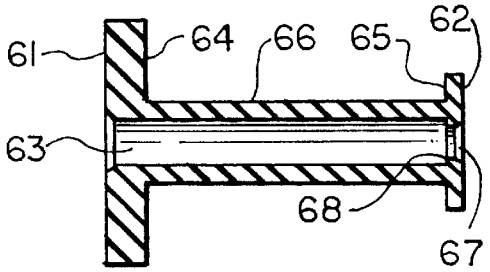
FIG. 6A is a cross-sectional side view of the insulator of FIG. 6.

FIG. 6 shows support 60. Support 60 is comprised of nylon or other insulative material. A first central bore 67 extends a short distance within the second end 62 of support 60. A first central bore 63, extends from a first end 61 to the second central bore 67, forming a first interior annular shoulder 68 where second bore 63 meets first bore 67. The first end 61 of support 60 includes a first exterior annular shoulder 64. The second end 62 of support 60 includes a second exterior annular shoulder 65. Third annular shoulder 65 has a smaller diameter than first exterior annular shoulder 64. A central section 66, having a diameter less than the diameter of second exterior annular shoulder 65 extends between the second exterior annular shoulder 65 and the first exterior annular shoulder 64.

Referring back to FIG. 1, the connector 10 has the second end of female body 20 received into the second end of entry body 30 and secured together by being press fit together or by other securement methods as are known in the art. The terminal 40 is disposed within the connector 10 such that the first end of the terminal extends beyond the first end of the entry body 30, while the second end of the terminal extends within the female body 20. The support 60 is positioned within the connector such that the first end is within the second central bore of the entry body 30, while the second end of support 60 is positioned within the first central bore of the female body 20. An insulator 50 is provided within the first end of the entry body and surrounds a section of terminal 40, thereby providing mechanical and electrical isolation of the terminal 40 from the entry body. The support 60 surrounds a portion of the terminal, from the second end of the terminal to the annular shoulder, with the first end of support 60 abutting the annular shoulder of the terminal.

A spring 70 is disposed surrounding a portion of the central section 66 of the support 60, and is arranged such that the spring provides a bias on the first exterior annular shoulder 64 of the support 60 and thus maintains a force on the interconnection of the terminal 40 to a cooperating receptacle (not shown) of an amplifier, thereby allowing a high amperage current to pass through the bypass connection.

An o-ring 80 may be provided adjacent the first mating area of the entry body 30 to provide a moisture proof seal when the connector is installed onto a cooperating receptacle (not shown) of an amplifier.

The connector is thus configured to handle up to approximately 15 amperes of current, to provide RF performance up to approximately 860 MHz and to provide approximately 75 ohms impedance. The connector provides power and/or RF bypass without disrupting the performance of the amplifier the connector is mated to.

Having described preferred embodiments of the invention it will now become apparent to those of ordinary skill in the art that other embodiments may be used. Accordingly, it is submitted that the invention should not be limited to the described embodiment but rather should be limited only by the spirit and scope of the appended claims.

We claim:

1. A power bypass connector for passing a high-amperage current, said connector having a predetermined matching impedance and comprising:

an entry body, open on each of a first end and a second end, having a central bore disposed therethrough, said entry body defining an interior space, said first end having a mating area;

a female body open in each of a first end and a second end, having an inner annular shoulder and a central bore disposed therethrough, said female body defining an interior space, said first end of said female body having a first mating area, said second end of said female body having a second mating area cooperating with said second end of said entry body;

a terminal having an annular shoulder disposed at a predetermined point on an exterior surface thereof, a first end and a second end, said first end including a central bore disposed a predetermined distance therein, said second end of said terminal disposed along a common longitudinal axis within said female body and said first end of said terminal extending beyond said first end of said entry body;

a support disposed within said connector and having a central bore disposed therethrough, said support surrounding a section of said terminal, said support also having an entry body end with an exterior annular shoulder and an interior annular shoulder, said interior annular shoulder in contact with said terminal annular shoulder;

a spring disposed about an outside surface of said support and between said interior annular shoulder of said female end and said support exterior annular shoulder, said spring maintaining a force on said terminal annular shoulder so that said terminal remains in tight contact with a cooperating receptacle.

2. The power bypass connector of claim 1 further comprising an insulator having a central bore disposed therethrough, said insulator surrounding a portion of said terminal, said insulator disposed along a common longitudinal axis within said entry body.

3. The power bypass connector of claim 1 further comprising an o-ring disposed about an outside surface of said entry body.

4. The power bypass connector of claim 1 wherein said terminal further comprises at least one slot disposed in said first end thereof.

5. The connector of claim 1 wherein said entry body further comprises a hexagonal shaped exterior surface.

6. The connector of claim 1 wherein said support and said insulator comprise insulative material.

7. The connector of claim 1 wherein said entry body mating area comprises ⅝"—24 threads.

8. The connector of claim 1 wherein said female body mating area comprises ⅜"—32 threads.

9. The connector of claim 1 wherein said entry body, said female body and said terminal comprise conductive material.

10. The connector of claim 9 wherein said entry body and said female body comprise brass.

11. The connector of claim 9 wherein said terminal comprises copper.

12. The connector of claim 9 wherein said terminal comprises silver plated copper.

13. A power bypass connector for passing a high-amperage current, said connector having a predetermined matching impedance and comprising:

an entry body, open on each of a first end and a second end, having a central bore disposed therethrough, said entry body defining an interior space, said first end having a mating area;

a female body open in each of a first end and a second end, having an inner annular shoulder and a central bore disposed therethrough, said female body defining an interior space, said first end of said female body having a first mating area, said second end of said female body having a second mating area cooperating with said second end of said entry body;

a terminal having an annular shoulder disposed at a predetermined point on an exterior surface thereof, a first end and a second end, said first end including a central bore disposed a predetermined distance therein, said second end of said terminal disposed along a common longitudinal axis within said female body and said first end of said terminal extending beyond said first end of said entry body;

a support disposed within said connector, having a central bore disposed therethrough, said support surrounding a section of said terminal, said support also having an entry body end with an exterior annular shoulder and an interior annular shoulder, said interior annular shoulder in contact with said terminal annular shoulder;

a spring disposed about an outside surface of said insulator and between said interior annular shoulder of said female end and said support exterior annular shoulder, said spring maintaining a force on said terminal annular shoulder so that said terminal remains in tight contact with a cooperating receptacle; and an insulator having a central bore disposed therethrough, said insulator surrounding a portion of said terminal, said insulator disposed within said entry body.

* * * * *